US006091206A

United States Patent [19]

Siao

[11] Patent Number: 6,091,206

[45] Date of Patent: Jul. 18, 2000

[54] ELECTRONIC BALLAST SYSTEM FOR FLUORESCENT LAMPS

[75] Inventor: Roger Siao, Los Banos, Calif.

[73] Assignees: Susan Siao, Los Banos; Anne Chon My Yeung, Burlingame, both of Calif.; part interest to each

[21] Appl. No.: 08/773,693

[22] Filed: Dec. 27, 1996

[51] Int. Cl.[7] ..... H05B 41/00; H05B 41/14

[52] U.S. Cl. ..... 315/219; 315/205; 315/344; 315/248; 315/278; 315/244; 315/324

[58] Field of Search ..... 315/277, 276, 315/219, 205, 323, 278, 324, 223, 344, 248

[56] References Cited

U.S. PATENT DOCUMENTS

| | | | |
|---|---|---|---|
| 2,923,856 | 2/1960 | Greene et al. | 315/219 |
| 3,691,450 | 9/1972 | Cox | 315/105 |
| 4,207,497 | 6/1980 | Capewell et al. | 315/96 |
| 4,245,178 | 1/1981 | Justice | 315/248 |
| 4,259,614 | 3/1981 | Kohler | 315/219 |
| 4,353,009 | 10/1982 | Knoll | 315/220 |
| 4,388,562 | 6/1983 | Josephson | 315/205 |
| 4,388,566 | 6/1983 | Bedard et al. | 315/291 |
| 4,392,087 | 7/1983 | Zansky | 315/219 |
| 4,631,449 | 12/1986 | Peters, Jr. | 315/205 |
| 5,339,004 | 8/1994 | Murphy | 315/244 |
| 5,399,944 | 3/1995 | Konopls et al. | 315/219 |
| 5,534,754 | 7/1996 | Poumey | 315/278 |
| 5,541,482 | 7/1996 | Siao | 315/248 |
| 5,559,405 | 9/1996 | otohamiprodjo | 315/209 R |
| 5,608,295 | 3/1997 | Moison | 315/247 |
| 5,786,670 | 7/1998 | Nguyen | 315/200 R |

FOREIGN PATENT DOCUMENTS

| | | | |
|---|---|---|---|
| 4298998 | 10/1992 | Japan | 315/219 |

*Primary Examiner*—Arnold Kinkead
*Attorney, Agent, or Firm*—Flehr Hohbach Test Albritton & Herbert LLP

[57] ABSTRACT

Electronic ballast system for fluorescent lights. A power oscillator connected to the primary winding of a power transformer for operation at a predetermined frequency in the range of 10 KHz to 5 MHz, and a ballasting network is connected to the secondary winding of the transformer and to one or more fluorescent lamps. The ballasting network is resonant at a frequency within about ±10 percent of the predetermined frequency, and in some embodiments, the resonant frequency of the ballasting network remains the same regardless of the number of lamps connected to it.

35 Claims, 4 Drawing Sheets

ELECTRONIC BALLAST SYSTEM FOR FLUORESCENT LAMPS

BACKGROUND OF THE INVENTION

1. Field of Invention

This invention pertains generally to fluorescent lighting and, more particularly, to an electronic ballast system for fluorescent lamps.

2. Related Art

Heretofore, electronic ballasts have been provided for use with fluorescent lamps. Examples of such ballasts are found in U.S. Pat. Nos. 4,245,178 and 4,631,449.

Electronic ballasts typically operate at frequencies on the order of 10 KHz to 100 KHz, and are designed to provide high circuit efficiency, high reliability, and low cost. While the physical size and weight of ballasts are dependent upon operating frequency, with higher frequencies permitting ballasts to be smaller in size and lighter in weight, reductions in size and weight have not been easy to achieve.

In order to reduce losses, multiple wires or Litz wires have been used for transformer windings, but they add substantially to the cost of manufacture. The cost can be reduced somewhat by using continuous windings on power transformers. However, that substantially reduces the coefficient of coupling and can result in high leakage flux which puts a heavy stress both on the transformer itself and on any switching devices or diodes used in the high energy path. In addition, leakage flux can also produce high voltage spikes and can cause electromagnetic interference in the nearby environment.

The higher flux drives and higher circulating currents required for reactive loading of a power transformer in prior systems can also increase core loss as well as loss in the windings themselves. To avoid such losses, it has heretofore been necessary to use larger cores and multiple conductors in the transformer windings.

OBJECTS AND SUMMARY OF THE INVENTION

It is in general an object of the invention to provide a new and improved ballast system for fluorescent lights.

Another object of the invention is to provide a ballast system of the above character which overcomes the limitations and disadvantages of the prior art.

These and other objects are achieved in accordance with the invention by providing an electronic ballast system which has a transformer with primary and secondary windings, a power oscillator connected to the primary winding for operation at a predetermined frequency in the range of 10 KHz to 5 MHz, and a ballasting network connected to the secondary winding and adapted for connection to the fluorescent lamp, with the ballasting network being resonant at a frequency within about ±10 percent of the predetermined frequency when connected to the lamp. In some embodiments, the resonant frequency of the ballasting network remains the same regardless of the number of lamps connected to it. Due to the resonance in the ballasting network, only resistive loading transformation occurs in the power transformer.

DETAILED DESCRIPTION

Figure 1:
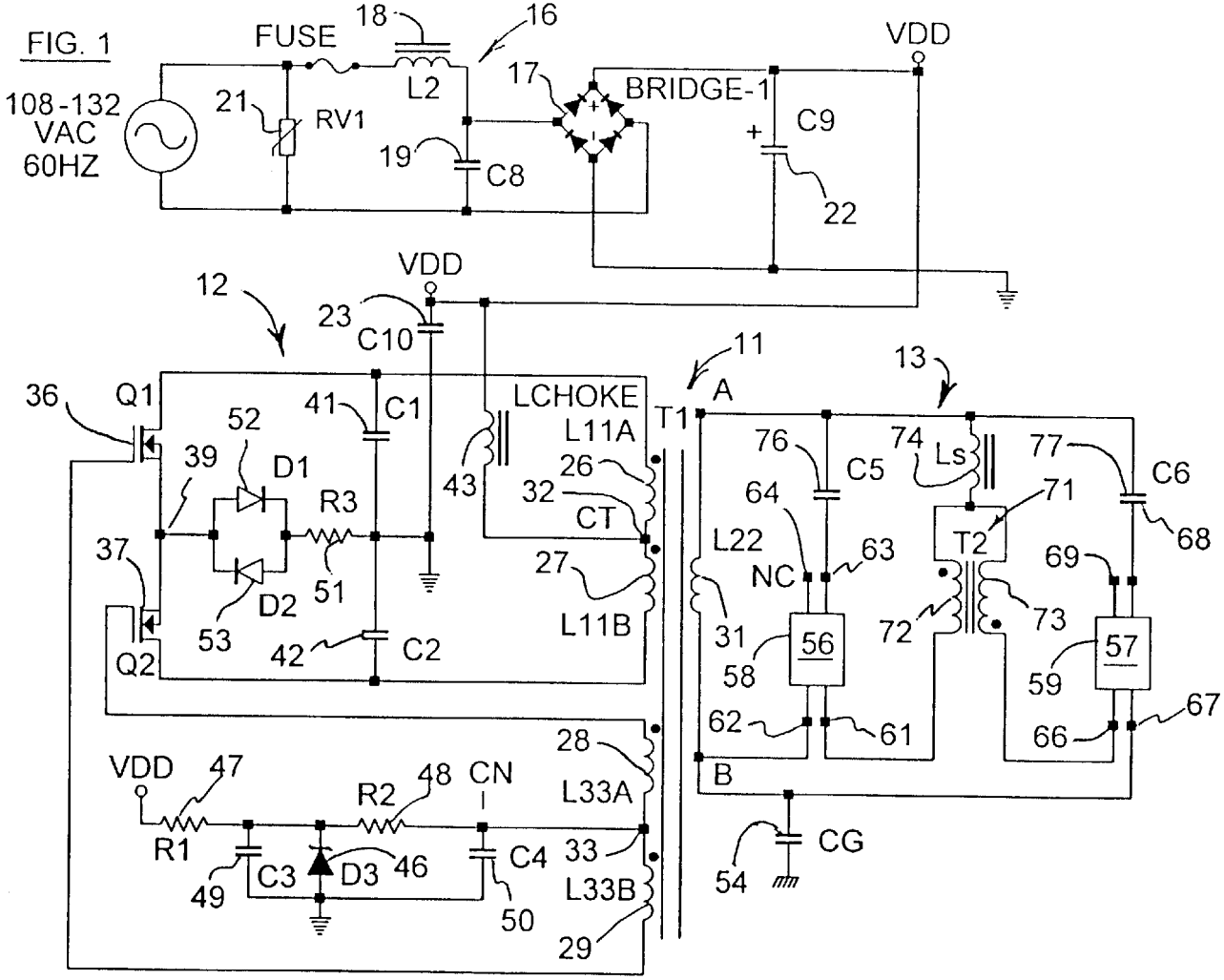
FIG. 1 is a circuit diagram of one embodiment of an electronic ballast system according to the invention.

As illustrated in FIG. 1, the ballast system includes a transformer 11, a power oscillator 12 connected to the primary of the transformer, and a ballasting network 13 connected to the secondary of the transformer. As discussed hereinafter in greater detail, the oscillator is doubly tuned, with the frequency determining components of the oscillator and the ballasting network being tuned to substantially the same frequency.

Operating power is provided by a power supply 16 which is connected to a standard (e.g., 120 volt, 60 cycle) AC source. The power supply includes full-wave bridge rectifier 17 which is connected to the source through a low-pass LC filter consisting of an inductor 18 and a capacitor 19. A varistor 21 is connected across the source to absorb transient disturbances from the power lines, and a filter capacitor 22 and an RF bypass capacitor 23 are connected to the output of the rectifier bridge. The supply provides a DC output voltage $V_{DD}$.

Transformer 11 has primary windings 26, 27, feedback or drive windings 28, 29, and a secondary winding 31. The two primary windings are connected together in series at a common node or center tap 32, and the two drive windings are connected together at a common node or center tap 33.

Power oscillator 12 is a doubly tuned, current switched, transformer coupled, Class-D power oscillator that includes a pair of switching transistors 36, 37, which in the embodiment illustrated are high power MOSFETs. It will be understood, however, that the invention is not limited to a particular type of switching device, and that other switching devices such as bipolar junction transistors (BJTs) or junction field effect transistors (JFETs) can be used.

The drains of the switching transistors are connected to the outer ends of primary windings 26, 27, and the gates are connected to the outer ends of drive windings 28, 29. The sources of the transistors are connected together at a common source node 39. Capacitors 41, 42 are connected between the outer ends of primary windings 26, 27, and the junction of the two capacitors is connected to ground. These capacitors resonate with the total inductance of the primary windings to determine the operating frequency of the oscillator, and they also serve to protect the switching transistors by providing a low AC impedance between the drains of the transistors and ground when subjected to high frequency transient signals or voltage spikes. The presence of the capacitors also makes the coefficient of coupling of the transformer less critical, and avoids the need for an extremely high coupling factor (e.g., a factor greater than 0.98). The values of the inductances and the capacitances are chosen to provide resonance at a frequency in the range 10 KHz to 5 MHz.

The voltages at the outer ends of drive windings 28, 29 are in phase with the voltages at the outer ends of primary windings 26, 27, which provides regenerative or positive feedback to establish and maintain self-oscillation in the circuit.

The supply voltage $V_{DD}$ is applied to the center tap or common node of the primary windings through an RF choke 43 which prevents AC fluctuations in the switching current of the oscillator.

The switching transistors are self-biased, and source degeneration is employed to ensure low power loss and high DC to AC conversion efficiency. A biasing voltage of substantially constant magnitude is provided by a voltage regulator consisting of a Zener diode 46 and a dropping resistor 47 connected between the output of the power supply and ground. The voltage developed across the Zener diode is applied to the center tap or common node of drive windings 28, 29 by a low pass filter consisting of a resistor 48 and a capacitor 49. In addition to coupling the reference voltage to the transistor inputs, the filter isolates the Zener diode from AC voltages in the drive windings. An AC bypass capacitor 50 is connected between the common node of the drive windings and ground.

A current sensing resistor 51 and a pair of parallel connected, back-to-back diodes 52, 53 are connected in series between the common source node 39 and ground to form a degenerative or negative feedback network which controls the gain and DC bias currents, and enhances the stability of the circuit. During operation, the gain of the circuit is decreased by the source voltage feedback, and any abnormal swing in the voltage at the drains of the transistors is automatically reduced, as is any abnormal current flowing through the transistors.

A grounding capacitor 54 is connected between the lower end of secondary winding 31 and the metal enclosure of the system to provide an AC path for EMI energy which radiates from electronic components and couples to the enclosure to return to circuit ground. The enclosure is connected to an earth ground, and the grounding capacitor also provides an AC current return path for the lamps during the capacitive discharge mode.

In the embodiment of FIG. 1, ballasting network 13 is specifically intended for use with instant-start fluorescent lamps 56, 57 which are mounted in sockets 58, 59. There are two internally connected connector pins at each end of the lamps, and the sockets have terminals 61–64 and 66–69 for contact with the pins.

The ballasting network comprises a differential transformer 71 which has tightly coupled windings 72, 73 with a coefficient of coupling near unity. Each of those windings is connected electrically in series with an inductor 74, with opposite phase ends of the windings being connected to one end of the inductor. The other end of the inductor is connected to the upper end of secondary winding 31 of transformer 11, and the remaining ends of windings 72, 73 are connected to terminals 61, 66 at the lower ends of the lamp sockets. The other terminals 62, 67 at the lower ends of the sockets are connected to the lower end of winding 31. Capacitors 76, 77 are connected between the upper end of secondary winding 31 and terminals 63, 68 at the upper ends of the lamp sockets. No connections are made to socket terminals 64, 69 in this embodiment.

Ballasting network 13 is thus a tank circuit in which capacitors 76, 77 are connected electrically in parallel with inductor 74 when the lamps are installed in their sockets. The inductances of the two windings 72, 73 of the differential transformer are equal to each other and to the inductance of series inductor 74. Capacitors 76, 77 are also equal in value.

With both lamps installed, the inductances of the two windings of the differential transformer cancel, and the resonant frequency of the tank circuit is determined by L in parallel with 2C, where L is the inductance of the series inductor, and 2C is the capacitance of capacitors 76, 77 in parallel.

With only one lamp installed, only one winding of the differential transformer and one of the two capacitors are connected in the circuit, and the resonant frequency is determined by 2L in parallel with C, where 2L is the inductance of the differential transformer winding in series with inductor 74, and C is the capacitance of the one capacitor in the circuit.

Thus, the resonant frequency of network 13 is the same with either or both of the lamps installed. That frequency is chosen to be substantially equal to the resonant frequency of the circuit on the primary side of transformer 11. The two frequencies do not have to be exactly equal, and the system will work quite well if they are within about ±10 percent of each other. With resonant circuits on both sides of the transformer, the power oscillator can be said to be doubly tuned.

If both lamps are removed from their sockets, all of the impedance elements in the ballasting network are disconnected from the secondary winding, the double tuned power oscillator becomes a single tuned oscillator, and the oscillator frequency is determined solely by the resonant tank circuit on the primary side of the transformer.

The natural frequency of the power oscillator remains constant regardless of the number of lamps which are connected. A plurality of resonant ballasting networks can be connected to the transformer secondary to drive any desired number of lamps, and those networks will all resonate at the frequency for which they are designed regardless of the number of lamps connected. Furthermore, the power dissipated by each lamp which is connected remains the same whether one lamp or more is/are connected.

Figure 2:
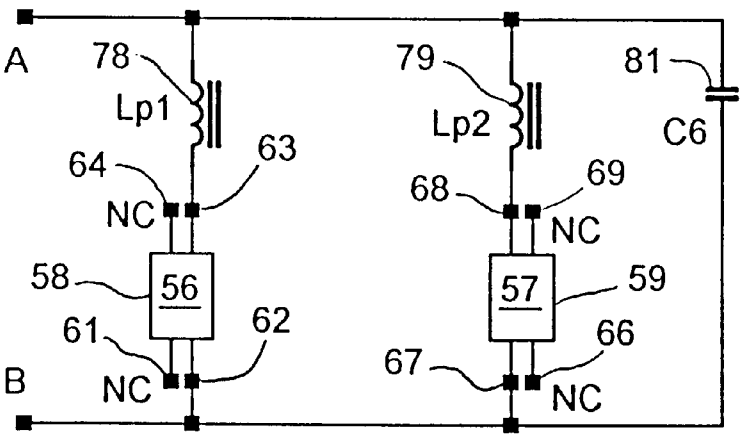
FIG. 2 is a circuit diagram of an embodiment of a ballasting network for use with instant-start lamps in the system of FIG. 1.

FIG. 2 illustrates another embodiment of a ballasting network for use with instant-start lamps wherein the resonant frequency and the power dissipated remain the same with one lamp or two. This network is similar to the network of FIG. 1 except the differential transformer 71 and series inductor 74 are replaced by two inductors 78, 79 of equal inductance.

With both lamps installed, the network consists of two identical parallel tanks, each of which is tuned to substantially the same frequency as the tank circuit on the primary side of the transformer. With one lamp removed, the network consists of a single tank circuit tuned to that frequency. With both lamps removed, the oscillator frequency is determined solely by the primary tank circuit. In all three cases, the frequency remains the same.

Figure 3:
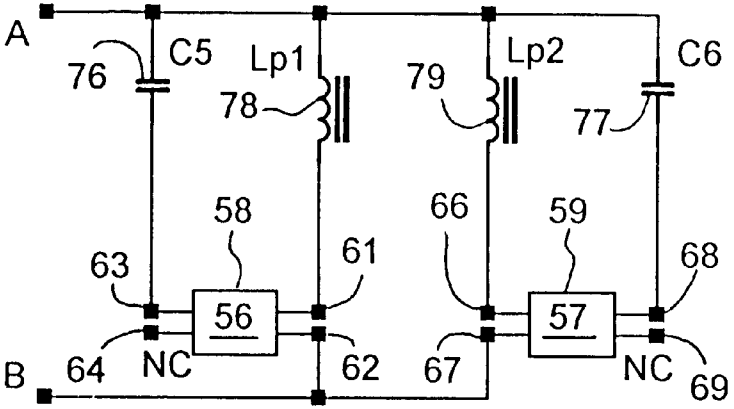
FIG. 3 is a circuit diagram of an embodiment of a parallel resonant ballasting network having a resonating capacitor in parallel with series inductors and the lamps for use in the system of FIG. 1.

In the embodiment of FIG. 3, inductors 78, 79 of equal inductance are once again connected in series with instant-start lamps. Here, however, a single resonating capacitor 81 is connected in parallel with the inductors and lamps. The resonant frequency of the combined parallel network is made equal to the resonant frequency of the primary circuit so that when both lamps are connected, the tank circuits on both sides of the transformer will be tuned to the same frequency. When one of the lamps is removed, however, the two resonant frequencies will be mismatched by a factor of 0.707.

Figure 4:
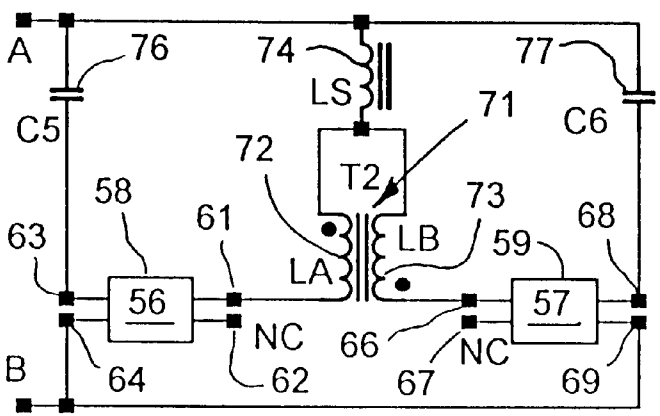
FIG. 4 is a circuit diagram of an embodiment of a parallel resonant ballasting network having a resonating inductor in parallel with series capacitors and the lamps for use in the system of FIG. 1.

The ballasting network of FIG. 4 is similar to the network of FIG. 3 except it has capacitors 82, 83 of equal value in series with the instant-start lamps and an inductor 84 in parallel with the capacitors and lamps. As in the embodiment of FIG. 3, the resonant frequency of the combined parallel network is made equal to the resonant frequency of the primary circuit so that when both lamps are connected, the tank circuits on both sides of the transformer will be tuned to the same frequency. When one of the lamps is removed, the two resonant frequencies will once again be mismatched by a factor of 0.707.

Figure 5:
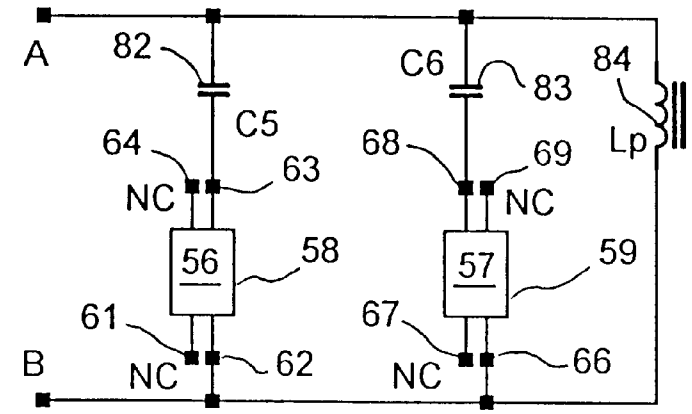
FIG. 5 is a circuit diagram of an embodiment of a ballasting network which is similar to the embodiment of FIG. 1 except for the terminals of the lamps to which the differential transformer is connected.

The ballasting network of FIG. 5 is similar to that shown in FIG. 1 except the bottom end of the secondary winding of transformer 11 is connected to terminals 64, 69 at the upper ends of the tubes, and terminals 62, 67 are left unconnected. This network operates in a manner similar to the network of FIG. 1, and the frequency characteristics of the two are the same.

Figure 6:
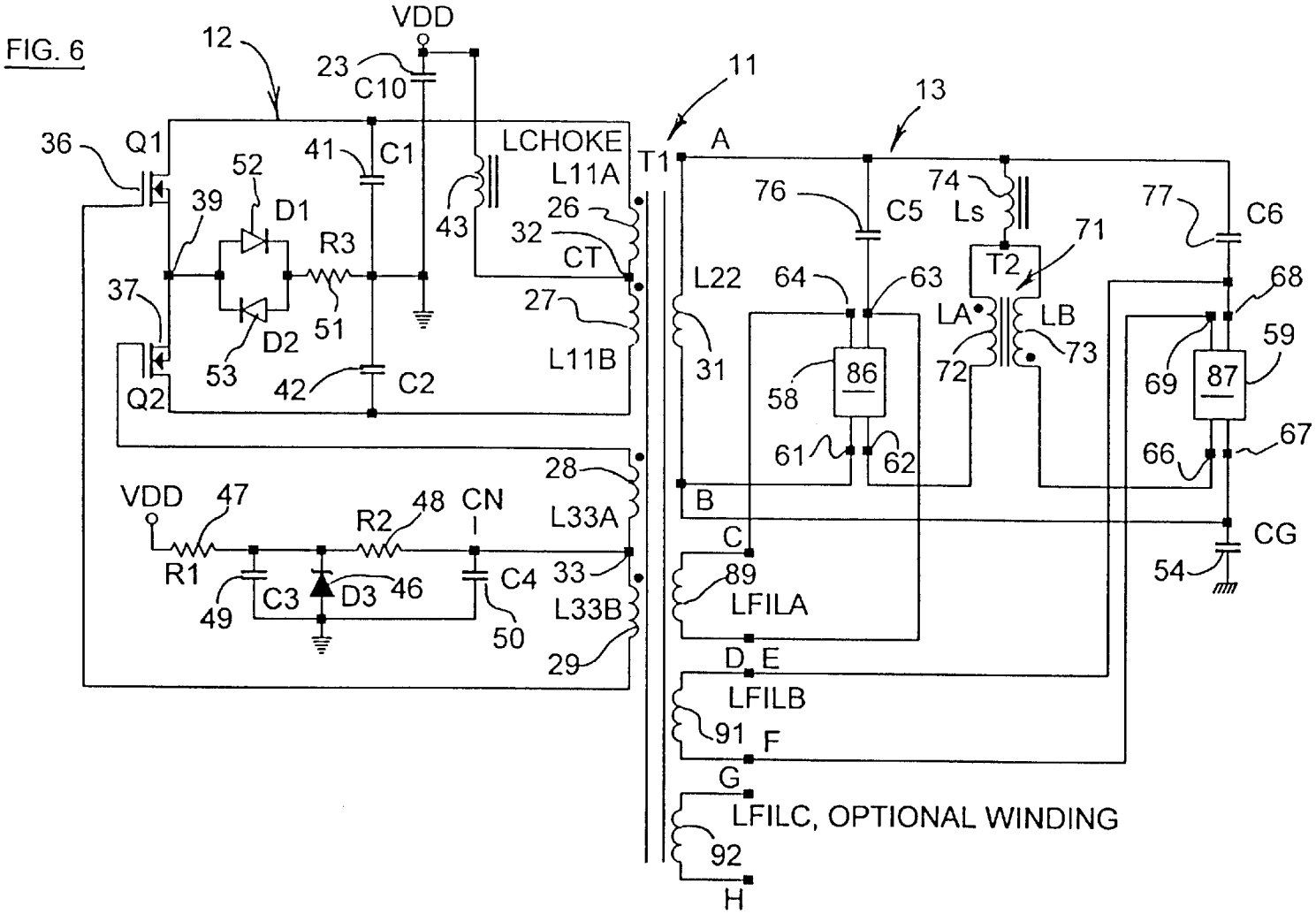
FIG. 6 is a circuit diagram of another embodiment of an electronic ballast system according to the invention which is particularly suitable for use with rapid-start fluorescent lamps.

FIG. 6 illustrates a system for use with rapid-start fluorescent lamps 86, 87. This embodiment is similar to that of FIG. 1, and like reference numerals designate corresponding elements in the two embodiments. In the embodiment of FIG. 6, however, transformer 11 has two filament windings 89, 91 which are connected to the cathode electrodes in the lamps which are connected to the series capacitors 76, 77 in the ballasting network. Thus, in this embodiment, two of the cathode electrodes are energized by the filament windings, and the other two are energized by the circulating current flowing through the series inductor 74. The addition of the filament windings does not affect the resonant frequency of the ballasting network, and that frequency remains the same whether one or two lamps are connected.

Ballasting networks similar to those shown in FIGS. 2–5 can also be used with rapid-start lamps in the system of FIG. 6, with filament windings 89, 91 powering the cathode electrodes at one end of the lamps. With the networks of FIGS. 3 and 4, a third filament winding 92 (shown in FIG. 6) is utilized for energizing the cathode electrodes at the other end of the lamps.

Figure 7:
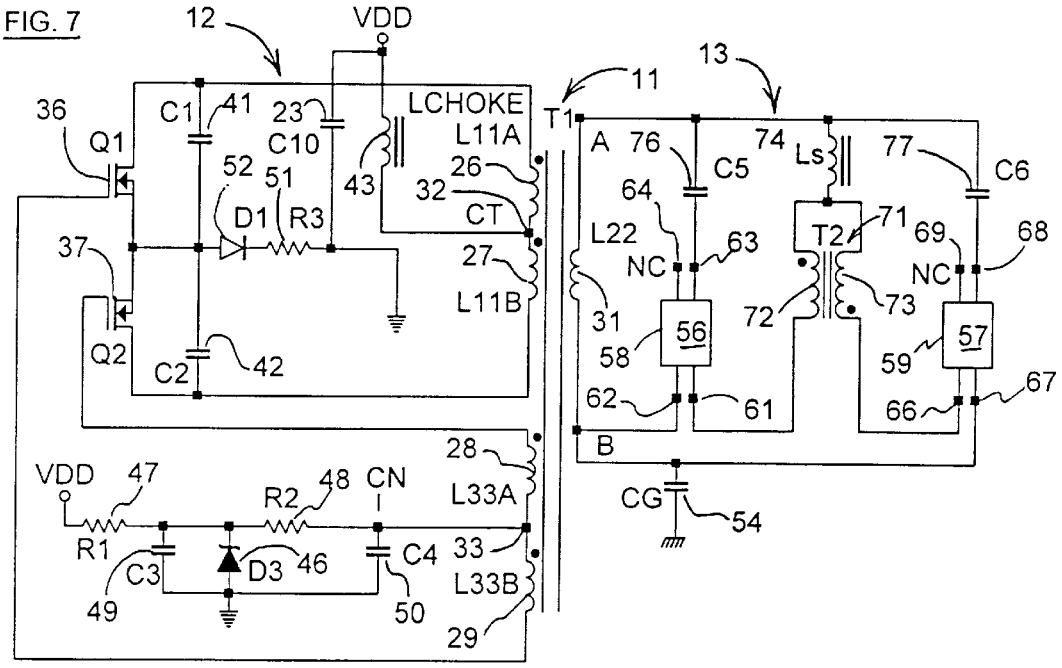
FIG. 7 is a circuit diagram of another embodiment of an electronic ballast system according to the invention which has frequency characteristics similar to the embodiment of FIG. 1.

FIG. 7 illustrates another embodiment which is similar to the embodiment of FIG. 1 except the junction of capacitors 41, 42 is connected to the common source node 39 of the switching transistors 36, 37, rather than being connected to ground. In this embodiment, only a single diode 52 is required rather than the back-to-back pair of FIG. 1. The frequency characteristics of this embodiment are identical to those of FIG. 1, and this embodiment can be utilized with any of the ballasting networks shown in FIGS. 2–5, either for instant-start lamps or for rapid-start lamps.

Figure 8:
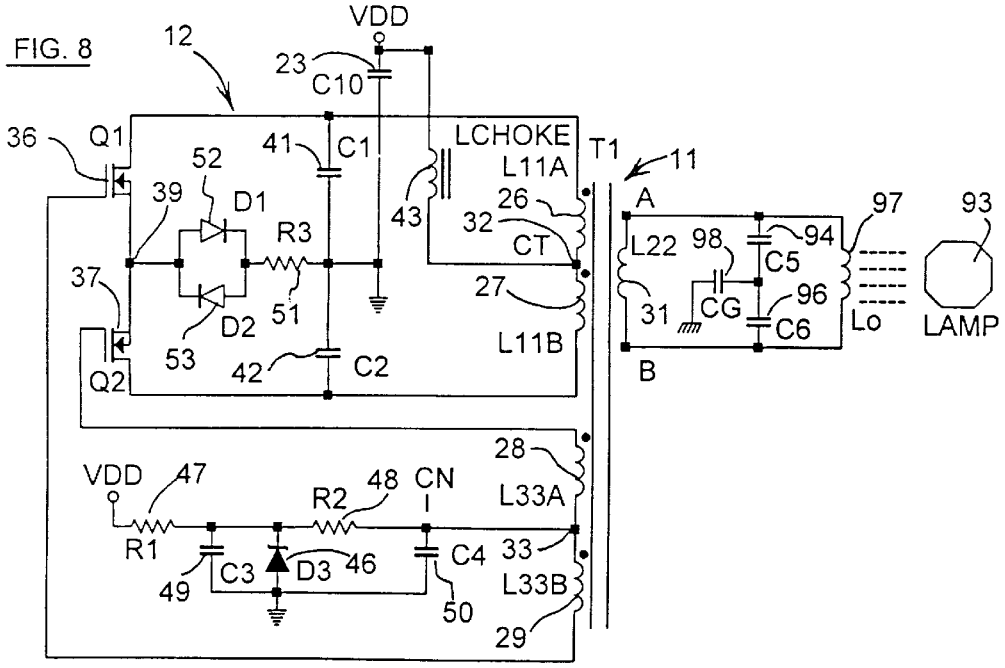
FIG. 8 is a circuit diagram of another embodiment of an electronic ballast system according to the invention which is particularly suitable for use with an induction discharge lamp.

FIG. 8 illustrates a system for use with an induction discharge lamp 93. This system is similar to the embodiment of FIG. 1, and like reference numerals designate corresponding elements in the two. In the embodiment of FIG. 8, however, the ballasting network consists of two capacitors 94, 96 of equal value connected in series across the secondary of transformer 11, and an inductor 97 which is connected in parallel with the two capacitors. An AC grounding capacitor 98 is connected between the junction of the capacitors 94, 96 and an earth ground. The tank circuit formed by capacitors 94, 96 and inductor 97 is tuned to substantially the same frequency as the tank circuit on the primary side of the transformer, and the inductor radiates an AC magnetic field which couples to the lamp.

The invention has a number of important features and advantages. It provides a simple, low cost, self-starting oscillator circuit which employs self-biased switching devices with emitter or source degeneration for starting and maintaining oscillation with low currents and low Q resonant conditions. The switching devices and power transformer are protected against damage from large voltage spikes and other transient disturbances, and sensitivity to the coefficient of coupling between the primary and secondary windings of the power transformer is also reduced.

During the transistor switching state, the leakage flux of a loosely coupled transformer can produce large voltage spikes across the switching devices or across any other semiconductors located within the path. By using two resonating capacitors to form a resonant tank at the primary winding, the leakage energy is recirculated through the transformer primary and is absorbed by the circuit loads. The combination of the capacitors, the series RF choke and the inductance of the primary winding also protects the switching transistors against large transient disturbances which can occur in the AC power lines.

With most of the ballasting networks employed in the invention, the oscillator operates at the same resonant frequency with one or two lamps connected, as well as with both lamps disconnected. Because of the resonant operating condition, the resultant impedance of the ballasting network and the lamps is purely resistive, and this permits components of smaller size and lower cost to be used.

The double tuning of the oscillator has another significant advantage in that the output of the secondary winding of the power transformer acts as a constant voltage and frequency source, which is an important factor in delivering a fixed power to each lamp.

It is apparent from the foregoing that a new and improved ballast system has been provided. While only certain presently preferred embodiments have been described in detail, as will be apparent to those familiar with the art, certain changes and modifications can be made without departing from the scope of the invention as defined by the following claims.

What is claimed is:

1. In an electronic ballast system for a fluorescent lamp: a power transformer having primary and secondary windings, a power oscillator connected to the primary winding with a tank circuit which is resonant at a predetermined frequency in the range of 10 KHz to 5 MHz, and a ballasting network connected to the secondary winding and adapted for connection to the fluorescent lamp in a parallel resonant circuit having a resonant frequency within about ±10 percent of the predetermined frequency.

2. In an electronic ballast system for fluorescent lamps: a power transformer having primary and secondary windings, a power oscillator connected to the primary winding for operation at a predetermined frequency in the range of 10 KHz to 5 MHz, and a ballasting network connected to the secondary winding and adapted for connection to a pair of fluorescent lamps in a parallel resonant circuit having a resonant frequency within about ±10 percent of the predetermined frequency, the ballasting network including impedance elements which are connected to a frequency determining circuit in response to presence of the lamps so that the resonant frequency of the ballasting network remains substantially the same when one or both of the lamps are connected.

3. The electronic ballast system of claim 2 wherein the ballasting network includes a pair of tank circuits each of which comprises an inductance connected across the secondary winding of the power transformer through contact pins on one of the fluroescent lamps and a capacitor connected in series with a respective one of the fluorescent lamps across the secondary winding of the power transformer.

4. The electronic ballast system of claim 2 wherein the ballasting network comprises a differential transformer having a pair of windings with first ends connected to one end of the secondary winding of the power transformer through the fluorescent lamps, a series inductor connected between second ends of the differential transformer windings and the other end of the secondary winding, and a resonating capacitor connected across the secondary winding through contact pins on each of the fluorescent lamps.

5. The electronic ballast system of claim 1 wherein the transformer performs a substantially resistive impedance transformation.

6. In an electronic ballast system for a fluorescent lamp:

a transformer having primary and secondary windings;

a Class-D power oscillator having a pair of resonating capacitors, a pair of switching transistors for alternately connecting respective ones of the capacitors in a tank circuit with the entire primary winding, and a pair of drive windings on the transformer connected to the switching transistors to provide positive feedback for starting and maintaining oscillation; and a ballasting network connected to the secondary winding for connection to a fluorescent lamp;

the tank circuit and the ballasting network being tuned to resonance at substantially the same frequency.

7. In an electronic ballast system for a fluorescent lamp:

a transformer having primary and secondary windings:

a Class-D power oscillator having a pair of resonating capacitors connected electrically in series with each other and in parallel with the primary winding of the transformer to form a tank circuit, a pair of switching transistors controlling the flow of current in a tank circuit, and a pair of drive windings on the transformer connected to the switching transistors to provide positive feedback for starting and maintaining oscillation;

negative feedback means connected to the switching transistors for decreasing the gain of the transistors in response to an increase in voltage on the transistors; and a ballasting network connected to the secondary winding for connection to a fluorescent lamp;

the tank circuit and the ballasting network being tuned to resonance at substantially the same frequency.

8. In an electronic ballast system for a fluorescent lamp:

a transformer having primary and secondary windings;

a Class-D power oscillator having a pair of resonating capacitors connected electrically in series with each other and in parallel with the primary winding of the transformer to form a tank circuit, a pair of switching transistors controlling the flow of current in the tank circuit, and a pair of drive windings on the transformer connected to the switching transistors to provide positive feedback for starting and maintaining oscillation; and a ballasting network connected to the secondary winding for connection to a fluorescent lamp;

the tank circuit and the ballasting network being tuned to resonance at substantially the same frequency;

the ballasting network also being adapted for connection to a second fluorescent lamp and including impedance elements which are connected to a frequency determining circuit in response to presence of the lamps so that the resonant frequency of the ballasting network remains substantially the same when one or both of the lamps are connected.

9. In an electronic ballast system for a fluorescent lamp:

a transformer having a primary winding with a center tap, a secondary winding, and a pair of drive windings connected electrically in series;

means for applying operating power to the center tap of the primary winding;

a pair of resonating capacitors connected electrically in series with each other and in parallel with the primary winding, with the junction of the capacitors being connected to ground;

a pair of switching transistors having drain elements connected to the capacitors, source elements connected to a common source node, and gate elements connected to the drive windings on the transformer;

a back-to-back pair of diodes connected in series with a sensing resistor between the common source node and ground;

means connected to the junction of the drive windings for applying a biasing voltage to the gate elements; and a ballasting network connected to the secondary winding for connection to a fluorescent lamp.

10. The electronic ballast system of claim 9 wherein the means for applying operating power to the center tap of the primary winding includes an RF choke.

11. The electronic ballast system of claim 9 wherein the ballasting network comprises a tank circuit having substantially the same resonant frequency as the resonating capacitors and the primary winding of the transformer.

12. The electronic ballast system of claim 9 wherein the ballasting network is adapted for connection to a plurality of fluorescent lamps and includes impedance elements which are connected together in response to presence of the lamps so that the resonant frequency of the network remains substantially the same regardless of the number of lamps which are connected.

13. In an electronic ballast system for a fluorescent lamp:

a transformer having a primary winding with a center tap, a secondary winding, and a pair of drive windings connected electrically in series;

means for applying operating power to the center tap of the primary winding;

a pair of switching transistors having drain elements connected to the primary winding, source elements connected to a common source node, and gate elements connected to the drive windings;

a pair of resonating capacitors connected between the source and drain elements of the transistors and forming a tank circuit with the primary winding;

a diode connected in series with a sensing resistor between the common source node and ground;

means connected to the junction of the drive windings for applying a biasing voltage to the gate elements; and a ballasting network connected to the secondary winding for connection to a fluorescent lamp.

14. The electronic ballast system of claim 13 wherein the means for applying operating power to the center tap of the primary winding includes an RF choke.

15. The electronic ballast system of claim 13 wherein the ballasting network comprises a tank circuit having substantially the same resonant frequency as the tank circuit formed by the resonating capacitors and the primary winding.

16. The electronic ballast system of claim 13 herein the ballasting network is adapted for connection to a plurality of fluorescent lamps and includes impedance elements which are connected to a frequency determining circuit in response to presence of the lamps so that the resonant frequency of the network remains substantially the same regardless of the number of lamps which are connected.

17. In an electronic ballast system for fluorescent lamps: a power transformer having primary and secondary windings, a power oscillator connected to the primary winding for operation at a predetermined frequency in the range of 10 KHz to 5 MHz, and a ballasting network comprising a differential transformer having a pair of windings with first ends connected to one end of the secondary winding of the power transformer through contact pins on the fluorescent lamps, a series inductor connected between second ends of the differential transformer windings and the other end of the secondary winding, and a resonating capacitor connected in series with each of the fluroescent lamps across the secondary winding, the ballasting network being resonant at substantially the predetermined frequency.

18. The electronic ballast system of claim 17 wherein the series inductor and each winding of the differential transformer are substantially equal in inductance, and the resonating capacitors connected in series with the lamps are of substantially equal capacitance.

19. In an electronic ballast system for fluorescent lamps: a power transformer having primary and secondary windings, a power oscillator connected to the primary winding for operation at a predetermined frequency in the range of 10 KHz to 5 MHz, and a ballasting network comprising a pair of tank circuits each of which comprises an inductance connected across the secondary winding of the power transformer through contact pins on one of the fluroescent lamps and a capacitance connected in series with a respective one of the fluorescent lamps across the secondary winding of the power transformer, the tank circuits being tuned to resonance at substantially the predetermined frequency.

20. In an electronic ballast system for fluorescent lamps: a power transformer having primary and secondary windings, a power oscillator connected to the primary winding for operation at a predetermined frequency in the range of 10 KHz to 5 MHz, and a ballasting network comprising a differential transformer having a pair of windings with first ends connected to one end of the secondary winding of the power transformer through the fluorescent lamps, a series inductor connected between second ends of the differential transformer windings and the other end of the secondary winding, and a resonating capacitor connected across the secondary winding through contact pins on each of the fluorescent lamps, the ballasting network being resonant at substantially the predetermined frequency.

21. In an electronic ballast system for a fluorescent lamp: a transformer having primary and secondary windings, a Class-D power oscillator connected to the primary winding by a resonant tank circuit, and a ballasting network connected to the secondary winding and to the fluorescent lamp to form a parallel resonant circuit which is tuned to resonance at substantially the same frequency as the tank circuit.

22. The electronic ballast system of claim 9 wherein the means for applying the biasing voltage to the gate elements includes a Zener diode having an anode connected to ground and a cathode connected to the junction of the drive windings by a low pass filter, a dropping resistor connected between a voltage source and the cathode of the Zener diode, and means connecting the cathode of the Zener diode to the gate elements.

23. The electronic ballast system of claim 13 wherein the means for applying the biasing voltage to the gate elements includes a Zener diode having an anode connected to ground and a cathode connected to the junction of the drive windings by a low pass filter, a dropping resistor connected between a voltage source and the cathode of the Zener diode, and means connecting the cathode of the Zener diode to the gate elements.

24. In an electronic ballast system for fluorescent lamps: a power transformer having primary and secondary windings, a power oscillator connected to the primary winding for operation at a frequency in the range of 10 KHz to 5 MHz, and a ballast network comprising a plurality of parallel branches each having a capacitor and a fluorescent lamp connected electrically in series across the secondary winding, and an inductor connected across the secondary winding to form a parallel resonant circuit with the branches.

25. In an electronic ballast system for fluorescent lamps: a power transformer having primary and secondary windings, a power oscillator connected to the primary winding for operation at a frequency in the range of 10 KHz to 5 MHz, and a ballast network comprising a plurality of parallel branches each having an inductor and a fluorescent lamp connected electrically in series across the secondary winding, and a capacitor connected across the secondary winding to form a parallel resonant circuit with the branches.

26. In an electronic ballast system for an induction discharge lamp: a power transformer having primary and secondary windings, a power oscillator connected to the primary winding for operation at a frequency in the range of 10 KHz to 5 MHz, a pair of capacitors connected electrically in series across the secondary winding, and an inductor for radiating an AC magnetic field which couples to the lamp, the inductor being connected in parallel with the capacitors to form a tank circuit which is tuned to substantially the frequency as the oscillator.

27. In an electronic ballast system for a fluorescent lamp:

a transformer having primary and secondary windings;

a pair of resonating capacitors;

a pair of switching transistors having source electrodes connected to a common source node and drain electrodes connected to the capacitors for alternately connecting the capacitors in a tank circuit with the primary winding of the transformer;

a diode connected in series with a sensing resistor between the common source node and ground;

a pair of drive windings on the transformer connected in opposite phase to the gate electrodes;

a biasing circuit comprising a Zener diode and a dropping resistor, with the dropping resistor being connected between a voltage source and the cathode of the Zener diode, and the anode of the Zener diode being connected to ground;

a low-pass filter comprising a resistor connected between the cathode of the Zener diode and the junction of the drive windings, and a capacitor connected between the cathode of the Zener diode and ground; and a ballasting network connected to the secondary winding for connection to a fluorescent lamp.

28. In an electronic ballast system for a fluorescent lamp:

a transformer having primary and secondary windings;

a pair of resonating capacitors each having first sides which are connected to opposite ends of the primary winding and second sides which are connected together;

a pair of switching transistors having source electrodes which are connected together and drain electrodes which are connected to the first sides of the capacitors;

a back-to-back pair of diodes connected in series with a sensing resistor between the source electrodes and the second sides of the capacitors;

means for turning the transistors on alternately to connect alternate ones of the capacitors in a tank circuit with the primary winding; and a ballasting network connected to the secondary winding for connection to a fluorescent lamp.

29. The electronic ballast system of claim 28 wherein the means for turning the transistors on comprises a pair of drive winding on the transformer connected to gate electrodes of the transistors.

30. The electronic ballast system of claim 29 further including a biasing circuit comprising a dropping resistor and a Zener diode, with the dropping resistor being connected between a voltage source and the cathode of the Zener diode, and means connecting the cathode of the Zener diode to the junction of the drive windings.

31. The electronic ballast system of claim 30 wherein the means connecting the cathode of the Zener diode to the junction of the drive windings comprises a low pass filter.

32. In an electronic ballast system for a fluorescent lamp:

a transformer having primary and secondary windings;

a pair of resonating capacitors each having first sides which are connected to opposite ends of the primary winding and second sides which are connected together;

a pair of switching transistors having source electrodes which are connected to the second sides of the capacitors and drain electrodes which are connected to the first sides of the capacitors;

a diode connected in series with a sensing resistor between the source electrodes and ground;

means for turning the transistors on alternately to connect alternate ones of the capacitors in a tank circuit with the primary winding; and a ballasting network connected to the secondary winding for connection to a fluorescent lamp.

33. The electronic ballast system of claim 32 wherein the means for turning the transistors on comprises a pair of drive winding on the transformer connected to gate electrodes of the transistors.

34. The electronic ballast system of claim 33 further including a biasing circuit comprising a dropping resistor and a Zener diode, with the dropping resistor being connected between a voltage source and the cathode of the Zener diode, and means connecting the cathode of the Zener diode to the junction of the drive windings.

35. The electronic ballast system of claim 34 wherein the means connecting the cathode of the Zener diode to the junction of the drive windings comprises a low pass filter.

* * * * *